US006681208B2

(12) United States Patent
Wu et al.

(10) Patent No.: US 6,681,208 B2
(45) Date of Patent: Jan. 20, 2004

(54) TEXT-TO-SPEECH NATIVE CODING IN A COMMUNICATION SYSTEM

(75) Inventors: Bin Wu, Higland Park, IL (US); Fan He, Grayslake, IL (US)

(73) Assignee: Motorola, Inc., Schaumburg, IL (US)

( * ) Notice: Subject to any disclaimer, the term of this patent is extended or adjusted under 35 U.S.C. 154(b) by 141 days.

(21) Appl. No.: 09/962,747

(22) Filed: Sep. 25, 2001

(65) Prior Publication Data

US 2003/0061048 A1 Mar. 27, 2003

(51) Int. Cl.[7] ..... G10L 13/08; G10L 13/06; G10L 21/06

(52) U.S. Cl. ..... 704/260; 704/278; 704/258

(58) Field of Search ..... 704/260, 258, 704/219, 268, 278; 711/103, 163; 379/416; 360/8

(56) References Cited

U.S. PATENT DOCUMENTS

| | | | | | |
|---|---|---|---|---|---|
| 4,405,983 | A | * | 9/1983 | Perez-Mendez | 711/163 |
| 4,817,157 | A | | 3/1989 | Gerson | |
| 4,893,197 | A | * | 1/1990 | Howells et al. | 360/8 |
| 5,119,425 | A | * | 6/1992 | Rosenstrach et al. | 704/219 |
| 5,463,715 | A | * | 10/1995 | Gagnon | 704/258 |
| 5,625,687 | A | * | 4/1997 | Sayre, III | 379/416 |
| 5,673,362 | A | * | 9/1997 | Matsumoto | 704/260 |
| 5,696,879 | A | * | 12/1997 | Cline et al. | 704/260 |
| 5,745,650 | A | | 4/1998 | Otsuka et al. | |
| 5,864,812 | A | * | 1/1999 | Kamai et al. | 704/268 |
| 5,896,393 | A | * | 4/1999 | Yard et al. | 711/103 |
| 5,924,068 | A | * | 7/1999 | Richard et al. | 704/260 |
| 5,940,791 | A | * | 8/1999 | Byrnes et al. | 704/258 |
| 5,956,681 | A | * | 9/1999 | Yamakita | 704/260 |
| 6,070,138 | A | * | 5/2000 | Iwata | 704/260 |
| 6,081,780 | A | * | 6/2000 | Lumelsky | 704/260 |
| 6,125,346 | A | | 9/2000 | Nishimura et al. | |
| 6,178,402 | B1 | | 1/2001 | Corrigan | |
| 6,246,983 | B1 | * | 6/2001 | Zou et al. | 704/260 |
| 6,272,587 | B1 | * | 8/2001 | Irons | 711/103 |
| 6,516,298 | B1 | * | 2/2003 | Kamai et al. | 704/260 |
| 2002/0147882 | A1 | * | 10/2002 | Pua et al. | 711/103 |

FOREIGN PATENT DOCUMENTS

| | | | | |
|---|---|---|---|---|
| JP | 62-165267 | | 7/1987 | |
| JP | 05-173586 | * | 7/1993 | G10L/3/00 |
| JP | 05-181492 | | 7/1993 | |
| JP | 08-160990 | * | 6/1996 | G10L/5/04 |
| JP | 08-335096 | | 12/1996 | |
| JP | 2000-148175 | | 5/2000 | |

OTHER PUBLICATIONS

Sagisaka ("Speech Synthesis From Text", IEEE Communications Magazine, Jan. 1990).*

O'Malley, M. et al. "Text–To–Speech Conversion Technology." *IEEE*; Aug. 1990 pp. 17–23.

Mobius, B. et al. "Modeling Segmental Duration in German Text–to–Speech Synthesis." *ICSLP 4th International Conference on Spoken Language*; Oct. 1996, vol. 4, pp. 2395–2398.

Sproat, R. et al. "EMU: and E–Mail Preprocessor for Text–To–Speech." *IEEE Second Workshop on Multimedia Signal Processing* ; Dec. 1998, pp. 239–244.

Silverman et al., TOBI: "A Standard for Labeling English Prosody", 2nd International Conference on Spoken Language Processing (ICSLP92): Oct. 1992, pp. 867–870.

* cited by examiner

*Primary Examiner*—Richemond Dorvil
*Assistant Examiner*—Daniel A. Nolan
(74) *Attorney, Agent, or Firm*—Brian M. Mancini

(57) ABSTRACT

A method of converting text to speech in a communication device includes providing a code table containing coded speech parameters. Next steps include inputting a text message into a communication device, and dividing the text message into phonics. A next step includes mapping each of the phonics against the code table to find the coded speech parameters corresponding to each of the phonics. A next step includes processing the coded speech parameters corresponding to each of the phonics to provide an audio signal. In this way, text can be mapped directly to a vocoder table without intermediate translation steps.

8 Claims, 3 Drawing Sheets

TEXT-TO-SPEECH NATIVE CODING IN A COMMUNICATION SYSTEM

FIELD OF THE INVENTION

The present invention relates generally to text-to-speech synthesis, and more particularly to text-to-speech synthesis in a communication system using native speech coding.

BACKGROUND OF THE INVENTION

Radio communication devices, such as cellular phones, are no longer viewed as voice only devices. With the advent of data based wireless services available to consumers, some serious problems arise for the conventional cellular phones. For example, cellular phones are currently only capable of presenting data services in text format on a small screen. This requires screen scrolling or other user manipulation in order to get the data or message. Also, comparing to landline systems, a wireless system has much higher data error rate and faces spectrum constraints, which makes providing real-time streaming audio, i.e. real-audio, to cellular users impractical. One way to deal with these problems is text-to-speech encoding.

The process of converting text to speech is generally broken down into two major blocks: text analysis and speech synthesis. Text analysis is the process by which text is converted into a linguistic description that can be synthesized. This linguistic description generally consists of the pronunciation of the speech to be synthesized along with other properties that determine the prosody of the speech. These other properties can include (1) syllable, word, phrase, and clause boundaries; (2) syllable stress; (3) part-of-speech information; and (4) explicit representations of prosody such as are provided by the ToBI labeling system, as known in the art, and further described in 2nd International Conference on Spoken Language Processing (ICSLP92): TOBI: "A Standard for Labeling English Prosody", Silverman et al, (October 1992).

The pronunciation of speech included in the linguistic description is described as a sequence of phonetic units. These phonetic units are generally phones or phonics, which are particular physical speech sounds, or allophones, which are particular ways in which a phoneme may be expressed. (A phoneme is a speech sound perceived by the speakers of a language). For example, the English phoneme "t" may be expressed as a closure followed by a burst, as a glottal stop, or as a flap. Each of these represents different allophones of "t". Different sounds that may be produced when "t" is expressed as a flap represent different phonics. Other phonetic units that are sometimes used are demisyllables and diphones. Demisyllables are half-syllables and diphones are sequences of two phonics.

Speech synthesis can be generated from phonics using a rule-based system. For example, the phonetic unit has a target phenome acoustic parameters (such as duration and intonation) for each segment type, and has rules for smoothing the parameter transitions between the segments. In a typical concatenation system, the phonetic component has a parametric representation of a segment occurring in natural speech and concatenates these recorded segments, smoothing the boundaries between segments using predefined rules. The speech is then processed through a vocoder for transmission. Voice coders, such as vector-sum or code excited linear prediction (CELP) vocoders are in general use in digital cellular communication devices. For example, U.S. Pat. No. 4,817,157, which is hereby incorporated by reference, describes such a vocoder implementation as used for the Global System for Mobile (GSM) communication system among others.

Unfortunately, the text-to-speech process as described above is computationally complex and extensive. For example, in existing digital communication devices, vocoder technology already uses the limits of computational power in a device in order to maintain voice quality at its highest possible level. However, the text-to-speech process described above requires further signal processing in addition to the vocoder processing. In other words, the process of converting text to phonics, applying acoustic parameters rules for each phonic, concatenation to provide a voiced signal, and voice coding require more processing power than just voice coding alone.

Accordingly, there is a need for an improved text-to-speech coding system that reduces the amount of signal processing required to provide a voiced output. In particular, it would be of benefit to be able to use the existing native speech coding incorporated into a communication device. It would also be advantageous if current low-cost technology could be used without the requirement for customized hardware.

SUMMARY OF THE INVENTION

The present invention finds use in communication devices, such as radiotelephones for example, that have audio capabilities that can take advantage of text-to-speech conversion of text messages.

One aspect of the present invention uses an existing vocoder with a stored code table containing coded speech parameters for use in text-to-speech conversion. These native speech parameters in a communication device can be used without the need to create and store new speech parameters. Instead, the native parameters can be modified if and when needed, such as to provide more natural-sounding language for example.

Another aspect of the present invention involves dividing the text messages into phonics, spaces, and special characters, and wherein white noise is used to emulate spaces between words of text. This saves time and code processing for non-phonics that do not contain any speech information.

Another aspect of the present invention involves the division of text into phonics which can be mapped against native coded speech parameters used in existing communication systems. For example, each distinct phonic can be mapped with a memory location index of predefined phonics in a look-up table to point to a digitized wave file defining equivalent native coded speech parameters from the code table.

DETAILED DESCRIPTION OF THE PREFERRED EMBODIMENTS

The present invention provides an improved text-to-speech system that reduces the amount of signal processing required to provide a voiced output by taking advantage of the digital signal processor (DSP) and sophisticated speech coding algorithms that already exist in cellular phones. In particular, the present invention provides a system that converts an incoming text message into a voice output using the native cellular speech coding and existing hardware of a communication device, without a increase in memory requirements or processing power.

Figure 1:
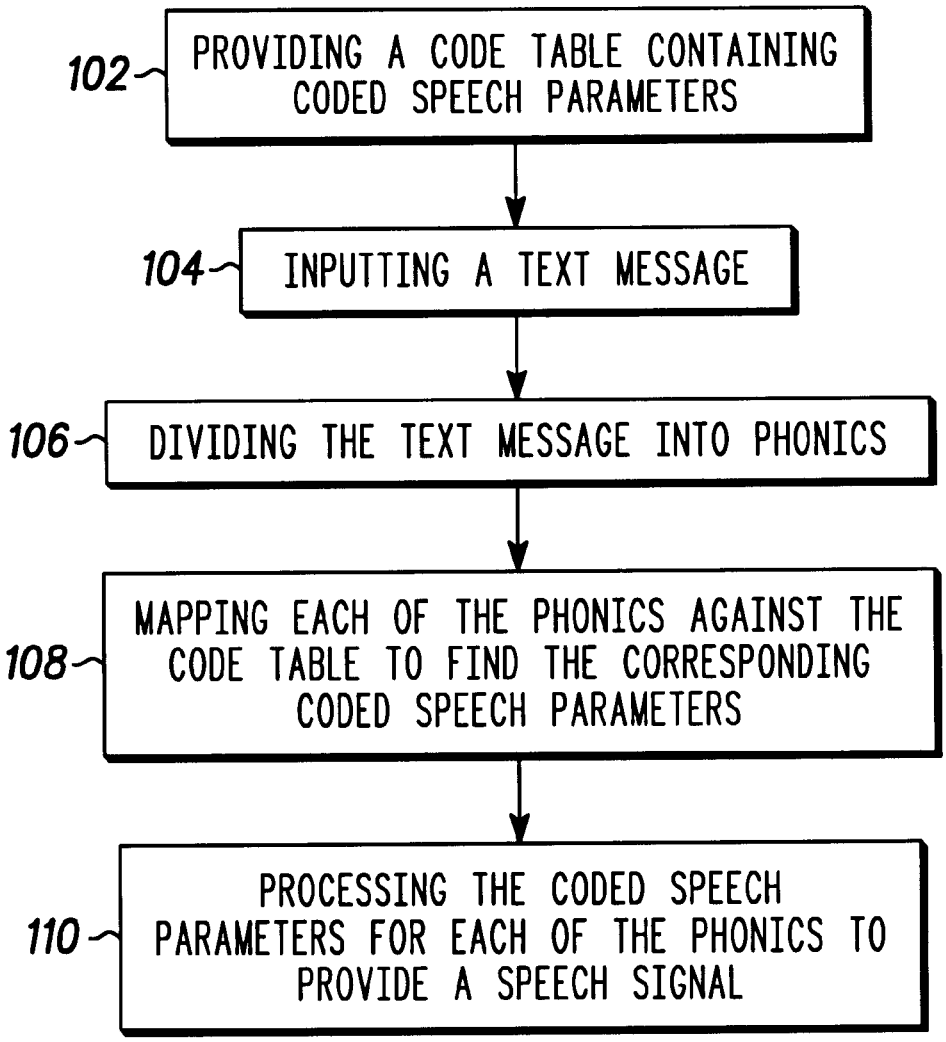
FIG. 1 shows a flow chart of a text-to-speech system, in accordance with the present invention.
Figure 2:
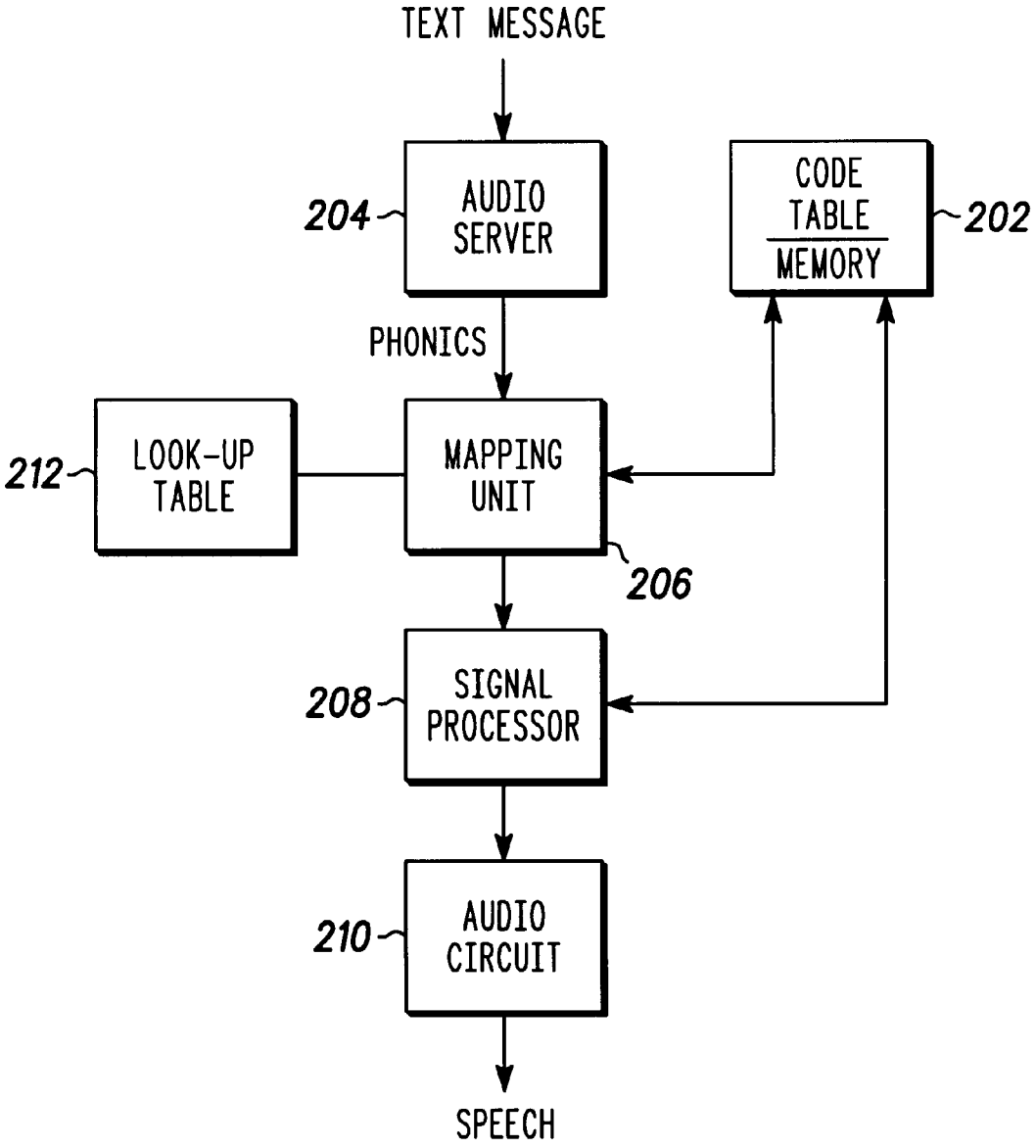
FIG. 2 shows a simplified block diagram of a text-to-speech system, in accordance with the present invention.

Advantageously, the present invention utilizes the exiting data interface between the microprocessor and DSP in a cellular radiotelephone along with existing software capabilities. In addition, the present invention can be used in conjunction with any text based data services, such as Short Messaging Service (SMS) as used in the Global System for Mobile (GSM) communication system, for example. Conventional cellular handsets have the following functionalities in place: (a) an air-to-air interface to retrieve test messages from remote service providers, (b) software to convert received binary data into appropriate text format, (c) audio server software to play audio to output devices, such as speakers or earphones for example, (d) highly efficient audio compression coding system to generate human voice through digital signal processing, and (e) a hardware interface between a microprocessor and a DSP. When receiving a text-based data message, a conventional cellular handset will convert the signal to text format (ASCII or Unicode), as is known in the art. The present invention converts this formatted text string to speech. Alternatively, a network server of the communication system can converts this formatted text string to speech and transmit this speech to a conventional cellular handset over a voice channel instead of a data channel FIGS. 1 and 2 show a method and system for converting text-to-speech in accordance with the present invention. In a preferred embodiment, the text will be converted to coded speech parameters native to the communication system, saving the processing steps of converting text-to-voice and then running the voice signal through a vocoder. In the method of the present invention, a first step 102 includes providing a code table 202 containing coded speech parameters. Such code tables are known in the art and typically include Code Excitation Linear Predictors (CELP) and Vector Sum Excited Linear Predictors (VSELP) among others. The code table 202 is stored in a memory. In effect, a code table contains compressed audio data representing critical speech parameters. As a result, the digital transfer of audio information can encoded and decoded using these code tables to reduce bandwidth providing more efficiency without a noticeable loss in voice quality. A next step 104 in the process is inputting a text message. Preferably, the text message is formatted in an existing format that can be read by the communication system without requiring hardware or software changes.

A next step 106 includes dividing the text message into phonics by an audio server 204. The audio server 204 is realized in the microprocessor or DSP of the cellular handset, or can be done in the network server. In particular, the text message is processed in an audio server 204 that is software based on a rule table for a particular language tailored to recognize the structure and phenomes of that language. The audio server 204 breaks the sentences of the text into words by recognizing spaces and punctuation, and further divides the words into phonics. Of course, a data message may contain other characters besides letters or may contain abbreviations, contractions, and other deviations from normal text. Therefore, before breaking a text message into sentences, these other characters or symbols, e.g. "$", numbers and common abbreviations, will be translated into their corresponding words by the audio server. To emulate the pause between each word in human speech, white noise is inserted between each word. For example, a 15 ms period of white noise has been found adequate to separate words.

Optionally, the text can contain special characters. The special characters include modifying information for the coded speech parameters, wherein after mapping the modifying information is applied to the coded speech parameters in order to provide more natural-sounding speech signal. For example, a special character (such as an ASCII symbol for example) can be used to indicate the accent or inflection of a word. For instance, the word "manual" can be represented "mánual" in text. The audio server software can then tune the phonetic to make the speech closer to a naturally inflected voice. This option requires the text messaging service or audio server to provide such special characters.

After linguistic analysis, a next step 108 includes mapping each of the phonics from the audio server, by a mapping unit 206, against the code table 202 to find the coded speech parameters corresponding to each of the phonics. In particular, each phonic is mapped into a corresponding digitized voice waveform that is compressed in the format that's native to a particular cellular system. For instance, in the GSM communication system, the native format can be the half rate vocoder format, as is known in the art. More particularly, each phonic has a predetermined digitized waveform, in the communication system native format, pre-stored in the memory. The audio server 204 determines a phonic, and the mapping unit 206 matches each distinct phonic with a memory location index of predefined phonics in a look-up table 212 to point to a digitized wave file defining the equivalent native coded speech parameters from the code table 202. Preferably, the look-up table 212 is used to map individual phonics into the memory location of the compressed and digitized audio in the existing code table of the vocoder of the cellular phone. For the English language, the look-up table size is slightly less than one megabyte with the GSM voice compression algorithm.

For example, there are about 4119 possible phonic combinations in English or a similar language. On average, the speed of the speech is about 200 words/min (about 500 phonics per minute and 6.7 phonics per second), thus each phonic lasts 0.15 s. With an 8 kHz sample rate and a 16-bit resolution, there are about 2400 bytes/phonic (0.15 s×8 kHz×2 bytes). With the 10:1 vocoder compression used in the GSM, the compressed digitized voice will be around 240 bytes/phonic. Thus, with about 4119 phonics the total size of the look-up table is about 989 kbytes for each language.

The mapping unit (which can also be the audio server) can then assemble the digitized representations of the phonics, along with white noise for spaces between words, into a string of data using the knowledge of the word and sentence structure learned from breaking the text into phonics.

In a next step 110, the native coded speech parameters, corresponding to each of the phonics from the previous step and along with suitable spaces, are subsequently processed in a signal processor 208 (such as a DSP for example) to provide a decompressed speech signal to an audio circuit 210 of the cellular phone handset, which includes an audio transducer. Inasmuch as the phonics are already coded in native parameters, the DSP needs no modification to properly provide a speech signal. To take advantage of the existing DSP capability, the coding system used for speech synthesis should be native to a particular cellular phone standard, since the DSP and its software are designed to decompress that particular coding format in an existing vocoder. For instance, in GSM-based handsets, digitized audio should be stored in the full-rate vocoder coding format, and can be stored in half-rate vocoder coding format. If the interface between a DSP and a microprocessor is shared memory, the audio file can be directly placed into the shared memory. Once the sentence is assembled, an interrupt will be generated to trigger a read by DSP, which in turn will decompress and play the audio. If the interface is a serial or parallel bus, the compressed audio will be stored in a RAM buffer until sentence is complete. After that, the microprocessor will transfer the data to DSP for decompression and play.

Preferably, the above steps are repeated for each sentence in the inputted text. However, it can be repeated for each phonic or up to the length of the available memory. For example, a paragraph, page or entire text can be inputted before being divided into phonics. In one embodiment, a transmitting step is included after the mapping step 108. This transmitting step includes transmitting the coded speech parameters from a network server to a wireless communication device, and wherein the processing step is performed in the wireless communication device and all the previous steps 102–108 are performed in the network server. However, in a preferred embodiment, all the steps 102–110 are performed within a wireless communication device. The text message itself can be provided by a network server or another communication device.

Unlike desktop and laptop computers, a cellular radiotelephone is a hand held device very sensitive to size, weight and cost. Thus, the hardware to realize the text-to-speech conversion of the present invention should use minimal number of parts and at low cost. The look-up table of the phonics should be stored in flash memory for its non-volatility and high density. Because the flash memory cannot be addressed randomly, the digital data of the phonics need to be loaded into the random memory before being sent to the DSP. The simplest way is to map the whole look-up table into the random memory, but this requires at least one megabyte of memory for a very simple look-up table. Another option is to load one sector from flash memory into the random memory at a time, but it this still requires 64 kbytes of extra random memory.

Figure 3:
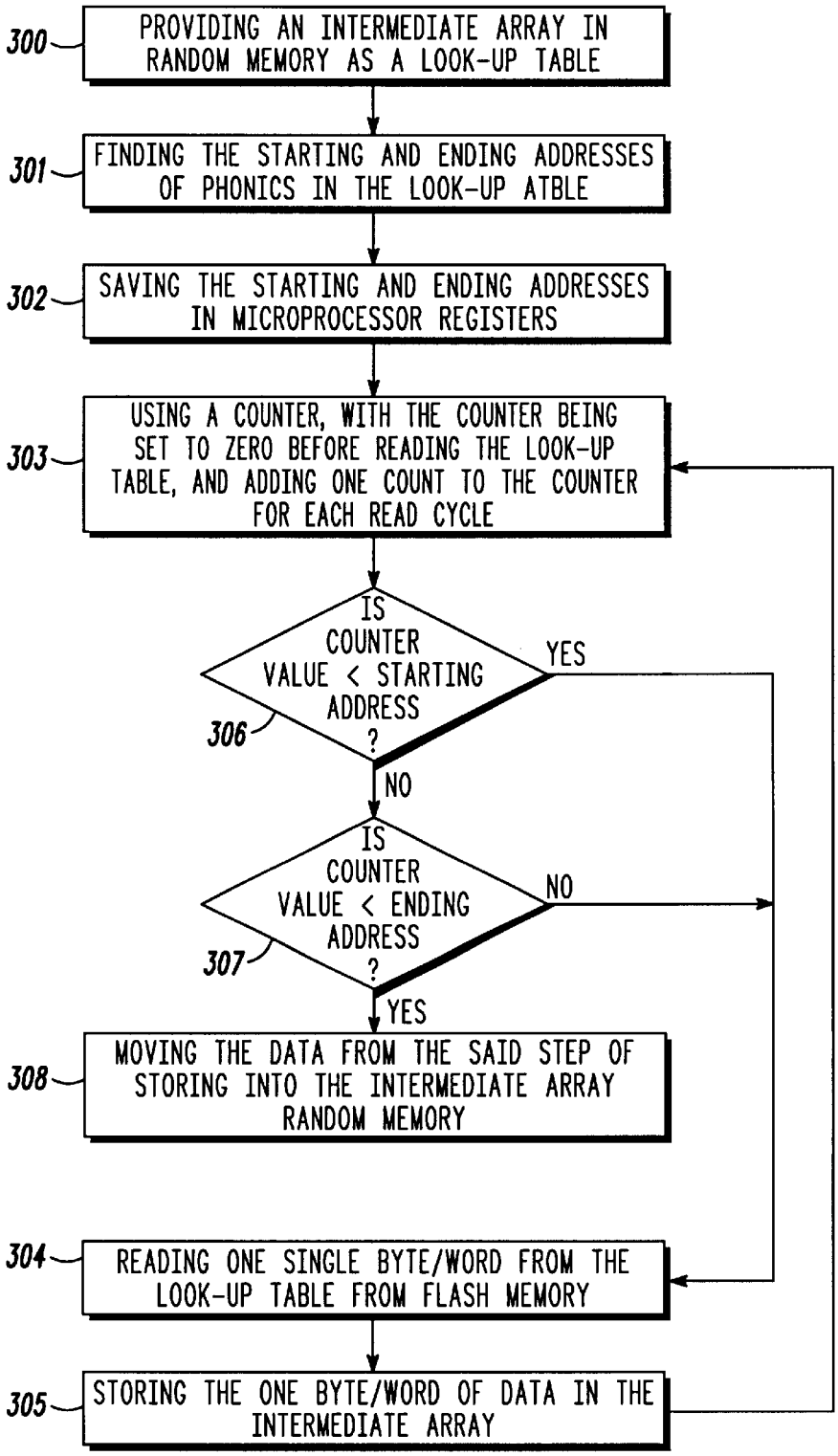
FIG. 3 shows a flow chart of a preferred embodiment of a text-to-speech system, in accordance with the present invention.

For the purpose of minimizing the requirement of the memory, the following approach can be used, referring to FIG. 3: laying out 300 an intermediate array in random memory as a look-up table, (a) find 301 the starting and the ending addresses of the phonics in the look-up table, (b) save 302 the starting and the ending addresses in the microprocessor registers, (c) use 303 one microprocessor register as a counter, with the counter being set to zero before reading the look-up table from the flash memory, adding one count to the counter for each read cycle, (d) read 304 one single byte or word of the look-up table from the flash memory in a non-synchronized mode or in a synchronized mode at a low clock frequency, so that the microprocessor can have enough time to perform necessary operation between the read cycles, and (e) use the microprocessor register to store 305 the one byte/word of data in the intermediate array, comparing 306 the counter value with starting address. If the counter value is less than the starting address, go back to the reading step 304 and read the next byte/word from the flash memory. If the counter value is equal or greater than the starting address, compare 307 the counter value with the ending address. If the counter value is less than the ending address, move the data from the microprocessor register into the random memory. If the counter value is greater than the ending address, go back to the reading step 304 and finish the reading to the end of the current flash memory sector. In this way, the requirement of the random memory can be limited to the size of 200 bytes. Thus, no additional random memory is required for even the simplest cellular phone handsets.

In the above example, phonics-digitized audio files are stored in a flash memory, which is accessible on a sector-by-sector basis. However, loading an entire page for one phonic file is both times consuming and inefficient. One method to improve the efficiency is to match all the phonics audio files stored on the same memory sector once it is loaded into the RAM. Instead of loading one memory page for one phonic then loading another page for next phonic, an intermediate array can be assembled that contains the memory locations of all phonics in a sentence. Table 1 shows a simple phonic-to-memory location look-up table.

TABLE 1

Look-up table structure

| Phonics (Text String ) | Page number (BYTE) | Starting Index (WORD) | Size of the file (WORD) |
|---|---|---|---|
| A | 3 | 210 | 200 |
| B | 4 | 1500 | 180 |
| C | 3 | 1000 | 150 |

Consider a sentence, "AB C", with a space between B and C. In a direct method, page 3 will be loaded into RAM, then copy 200 bytes starting at location 210 to a memory buffer. Page 4 is then loaded, copy 180 bytes into a buffer starting at location 1500. Then copy a digitized white noise segment into the buffer, after that load page 3 again, copy 150 Bytes starting at location 1000 into the buffer. The text string is then converted to audio. An indirect method can also be used. The different between the direct and indirect method is that in direct method the software will not look ahead. Therefore, in the above example, (AB C), software will load page 3, locate and copy A, then load page 4 and locate and copy B, then reload page 3 and locate and copy C, while in the indirect method, software will load page 3 and copy both A and C into a pre-allocated memory buffer, than load page 4 and copy B into the buffer. In this way, only a two page load is required which saves time and processor power.

With an intermediate mapping method, "AD C" is translated to a memory location array, {3:210:200, 4:1500:180, 3:1000:150}. A memory buffer to store digitized audio is created based upon the total size required, in this case the sum of three phonics (200+1804+150) plus a white noise segment for the space. After loading page 3 into memory, the memory location array is searched to locate all the audio files that are stored on this page, in this case A and C, which are then copied to their respected locations in the memory buffer. With this method, we can significantly cut down the memory access time and improve the efficiency.

In practice, the present invention uses existing text based messaging services in a communication system. SMS (Short message service) is a popular text based message service for GSM system. Under certain situations, i.e. driving or it being too dark to read, converting a text message into speech is very desirable. In addition, all current menu, phone book and operational prompts are in text format in current cellular handsets. It is not possible for the visually impaired to navigate through these visual prompts. The text-to-speech (TTS) system as described above solves this problem. Instead of sending data in bandwidth intensive voice format (although this can also be used), the present invention allows the use of the many communication services having a low data rate text format, such as SMS for example. This can be used to advantage in real time driving directions, audio news, weather, location services, real time sports or breaking newscasts in text. TTS technology also opens a door for voice game application in cellular phones at very low cost.

Moreover, TTS can use much lower bandwidth with text based messaging. It will not load the network and worsen the capacity strain on existing or future cellular networks. Further, the present invention allows incumbent network operators to offer a wide range of value-added services with the text messaging capabilities that already existed in their networks, instead of having to purchase licenses for new bandwidth and investing in new equipment. This also applies to third party service providers that, under today's and proposed technologies, face even higher obstacles than network operators in providing any kind of data services to cellular phone users. Since TTS can be used with any standard text messaging services, anyone with the access to text-messaging gateways can provide a variety of services to millions of cellular phone users. With the technology and equipment barrier removed, many new business opportunities will be opened up to the independent third party application providers.

Like existing mobile web applications, the mobile TTS application also requires network server support. The server should be optimized based on the data traffic and the cost per user. The major daily cost of the local server is the data traffic. Low data traffic reduces the server return on investment and the daily cost. The present invention can increase low data traffic and moderate data traffic since text does not need to be sent "on demand" when data traffic bandwidth may be unavailable, but can wait for period of lower, available data traffic.

Although the invention has been described and illustrated in the above description and drawings, it is understood that this description is by way of example only and that numerous changes and modifications can be made by those skilled in the art without departing from the broad scope of the invention. Although the present invention finds particular use in portable cellular radiotelephones, the invention could be applied to any communication device, including pagers, electronic organizers, and computers. The present invention should be limited only by the following claims.

What is claimed is:

1. A method of converting text to speech in a communication device operable to receive text messages and having a vocoder with a stored code table containing coded speech parameters, the method comprising the steps of:

inputting a text message into the communication device;

dividing the text message into phonics;

mapping each of the phonics against the existing vocoder code table to find the coded speech parameters corresponding to each of the phonics by matching each distinct phonic with a memory location index of predefined phonics in a look-up table to point to a digitized wave file defining equivalent native coded speech parameters from the code table comprising the substeps of:

providing an intermediate array in random memory as a look-up table;

finding the starting and the ending addresses of the phonics in the look-up table;

saving the starting and the ending addresses in microprocessor registers;

using one microprocessor register as a counter, with the counter being set to zero before reading the look-up table, and adding one count to the counter for each read cycle;

reading one single byte/word from the look-up table from flash memory;

storing the one byte/word of data in a microprocessor register, and comparing the counter value with starting address, wherein if the counter value is less than the starting address, go back to the reading step to read the next byte/word from memory, and if the counter value is equal or greater than the starting address, comparing the counter value with the ending address, wherein if the counter value is less than the ending address, moving the data from the said step of storing the one byte/word of data in a microprocessor register into the intermediate array random memory, and if the counter value is greater than the ending address, go back to the reading step and finish the reading to the end of the memory; and subsequently processing the coded speech parameters corresponding to each of the phonics from the previous step in the vocoder of the communication device to provide a speech signal from the communication device.

2. The method of claim 1, wherein the dividing step includes dividing the text messages into phonics, spaces, and special characters, and wherein spaces are emulated with white noise.

3. The method of claim 2, wherein the special characters of the dividing step include modification information for the coded speech parameters, and wherein after the mapping step further comprising a step of applying the modification information to the coded speech parameters in order to provide more natural-sounding speech signal from the processing step.

4. The method of claim 1, wherein in the providing step the code table includes one of code excited linear prediction parameters or vector sum excited linear prediction parameters.

5. A communication device for converting text-to-speech, the device operable to receive text messages and having a vocoder with a stored code table containing coded speech parameters, the communication device comprising:

an audio server that converts input text into phonics;

a mapping unit that maps each of the phonics against the existing vocoder code table to find the coded speech parameters corresponding to each of the phonics by matching each distinct phonic with a memory location index of predefined phonics in a look-up table to point to a digitized wave file defining equivalent native coded speech parameters from the code table by having the mapping unit:

provide an intermediate array in random memory as a look-up table;

find the starting and the ending addresses of the phonics in the look-up table;

save the starting and the ending addresses in microprocessor registers;

use one microprocessor register as a counter, with the counter being set to zero before reading the look-up table, and adding one count to the counter for each read cycle;

read one single byte/word from the look-up table from flash memory;

store the one byte/word of data in a microprocessor register, and compare the counter value with starting address, wherein if the counter value is less than the starting address, read the next byte/word from memory, and if the counter value is equal or greater than the starting address, compare the counter value with the ending address, wherein if the counter value is less than the ending address, move the data that was stored as one byte/word of data in the microprocessor register from the microprocessor register into the intermediate array random memory, and if the counter value is greater than the ending address, go back to reading and finish reading to the end of the memory; and a signal processor incorporated in the vocoder of the communication device that processes the coded speech parameters corresponding to each of the phonics to provide a speech signal from the communication device.

6. The communication device of claim 5, wherein the audio server converts the input text into phonics, spaces and special characters, and wherein spaces are emulated with white noise.

7. The communication device of claim 5, wherein the audio server converts the input text into phonics, spaces and special characters that include modification information for the coded speech parameters, and applies the modification information to the coded speech parameters in order to provide a more natural-sounding speech signal.

8. The communication device of claim 5, wherein the code table is an existing code table used in a vocoder of the communication system.

* * * * *